US005930104A

United States Patent [19]

Kadah et al.

[11] Patent Number: 5,930,104

[45] Date of Patent: Jul. 27, 1999

[54] PWM RELAY ACTUATOR CIRCUIT

[75] Inventors: Andrew S. Kadah, Manlius, N.Y.; Hassan B. Kadah, Hortonville, Wis.; Benjamin V. Morrow, West Monroe, N.Y.

[73] Assignee: International Controls and Measurement Corp., Cicero, N.Y.

[21] Appl. No.: 09/036,134

[22] Filed: Mar. 6, 1998

[51] Int. Cl.[6] ..... H01H 47/28

[52] U.S. Cl. ..... 361/187; 361/156; 361/190

[58] Field of Search ..... 361/144, 152, 361/159, 160, 170, 189, 194, 154, 153, 187; 318/126, 127, 129, 130; 307/127; 123/490, 499

[56] References Cited

U.S. PATENT DOCUMENTS

| | | | |
|---|---|---|---|
| 3,676,601 | 7/1972 | Shaffer | 179/16 E |
| 4,266,261 | 5/1981 | Streit et al. | 361/154 |
| 4,639,822 | 1/1987 | Kubach et al. | 361/155 |
| 5,343,351 | 8/1994 | Quantz | 361/33 |
| 5,381,297 | 1/1995 | Weber | 361/143 |
| 5,430,600 | 7/1995 | Burns | 361/153 |
| 5,558,065 | 9/1996 | Arakawa | 123/490 |
| 5,717,562 | 2/1998 | Antone et al. | 361/155 |

*Primary Examiner*—Jeffrey Gaffin
*Assistant Examiner*—Kim Huynh
*Attorney, Agent, or Firm*—Trapani & Molldrem

[57] ABSTRACT

An actuation circuit for an electromechanical relay employs a microprocessor and a switching transistor to actuate a relay over a wide range of applied voltages. The switching transistor is connected in series with the actuator coil. A voltage sensing circuit is connected to one input of the microprocessor, which produces a pulse-width modulated actuator output to gate the switching transistor. The microprocessor is suitably programmed so as to produce a pulse width modulated signal actuator signal whose duty cycle is a function of applied voltage. The RMS current through the relay coil is sufficient to ensure good actuation, but does not overstress the coil. The relay is selected to have its rated actuation voltage at or below a lower end of the expected range of applied voltages. A relay actuation boost arrangement can include a transistor or an SUS (silicon unidirectional switch) or similar negative resistance device.

9 Claims, 2 Drawing Sheets

PWM RELAY ACTUATOR CIRCUIT

BACKGROUND OF THE INVENTION

The present invention relates to actuation circuits for high-current switching devices such as relays or contactors, that is, devices in which the appearance of a pilot current or voltage causes the opening or closing of a controlled switching device. This invention is more particularly concerned with a simple and inexpensive actuation circuit which ensures smooth operation of a relay actuator coil over a wide voltage range without chatter and without overheating.

Electromechanical relays are electromagnetic devices in which current flowing through a coil actuates (i.e., closes or opens) a pair of electrical contacts. This can occur in a number of well known ways, but usually an iron armature is magnetically deflected towards a soft iron core of the coil to make (or break) the controlled circuit.

Each relay is designed for a fairly specific range of operating voltages. For example, a relay may be designed to operate at a nominal 15 volts, in which case it may have a design operating range of about 12 to 18 volts. At voltages much below twelve volts, the current through the actuator coil may be too small to close the relay contacts, or may cause the contacts to close intermittently and "chatter." On the other hand, at voltages much above eighteen volts, the increased current through the coil can cause overheating or coil burn-out, and also represents wasted energy.

In some designs with DC relays, a wide operating voltage is required, but a specific relay must be specified for the circuit design. If the relay selected is of a nominal voltage, it may chatter or buzz on pick up if the voltage is too low. This can cause excessive arcing of the relay contacts, and could potentially weld or damage the contacts. On the other hand, if the relay is selected of lower than nominal voltage, it may be overstressed when the voltage is high but is still in the expected range.

One possible solution is to employ a voltage regulator circuit to keep the relay voltage constant. However, the voltage regulator itself consumes energy, and also requires heat sinking for power dissipation.

Furthermore, in many environments the voltages applied to these relays have varied far more than was originally expected. For example, in a recreational motor home environment, because of unusual wiring, load, and power production conditions, a nominal 117 volts (RMS) has appeared as low as 63 volts and over 160 volts (RMS). When converted in a nominal 24 volt (5:1) thermostat transformer, the corresponding voltage range is from only 13 volts to above 33 volts.

OBJECTS AND SUMMARY OF THE INVENTION

It is an object of this invention to provide a control or driver circuit for an electromechanical relay that avoids the drawbacks of the prior art as mentioned above.

It is another object to provide a relay control or driver circuit that accommodates an extreme range of actuation voltage, but avoids bounce, switch noise, arcing, or overheating.

It is a further object to provide a relay control or driver circuit that is reliable, efficient, and prolongs relay life.

According to an aspect of the invention, a control circuit is adapted for energizing an actuator coil of a relay over a wide range of operating voltages, and is connected with an actuator voltage source which applies an actuating voltage across a pair of conductors to which the relay coil is connected. A switching transistor is connected in series with the actuator coil. That is, the transistor has its collector and emitter, or source and drain, for example, connected between one end of the coil and one of the conductors. A microprocessor has a control output terminal coupled to the gate or base, i.e., the control electrode of the switching transistor. A voltage sensing arrangement, which can be a simple series circuit, is connected across the pair of conductors to sense the level of applied actuator voltage. This voltage sensing arrangement applies a voltage signal to a voltage input of the microprocessor. This voltage signal is generally proportional to the voltage across the conductors within the range of expected operating voltages.

The microprocessor is suitably programmed so as to produce a PWM actuator signal at its control output. That is, the actuator signal is pulse width modulated to have a duty cycle that is a function of the voltage signal within the range of operating voltage.

The circuit may include a charge storage or booster arrangement for applying an increased voltage at the commencement of actuation. This feature avails upon the characteristic of the relay that requires a higher voltage for pickup than what is needed to maintain closure. In one embodiment a capacitor is charged up by the flyback voltage from the relay actuator coil. The microprocessor can apply a suitable pulse actuator signal to the switching transistor for this purpose. In addition, the microprocessor can apply a DC signal for a short time, e.g., one second, when the relay closes and again when it opens, so that contact opening and closing is clean and chatter-free.

The actuator circuit of this invention is of a simple, straightforward design. The circuit is inherently compact, avoids energy waste in applying current to the actuator coil, and also avoids the requirement for cooling or other protective equipment for the relay or contactor.

The above and many other objects, features, and advantages of this invention will become apparent from the ensuing description of a preferred embodiment, which should be read in conjunction with the accompanying Drawing.

DETAILED DESCRIPTION OF THE PREFERRED EMBODIMENTS

Figure 1:
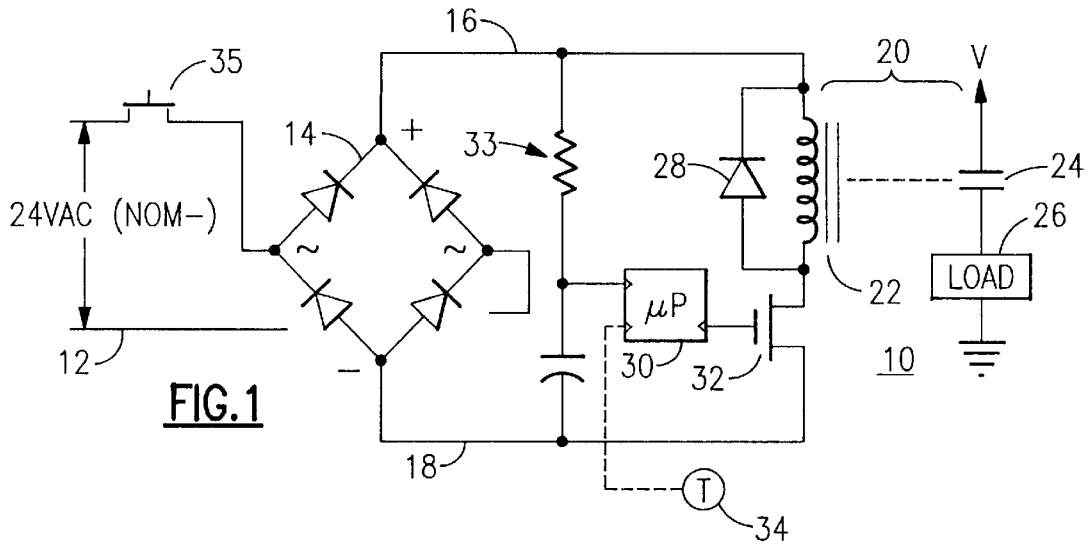
FIG. 1 is a circuit diagram for a PWM relay actuator circuit according to one possible embodiment of the present invention.

With reference to the Drawing, FIG. 1 is a circuit diagram of an illustrative embodiment of a relay actuator circuit 10. Here there is an AC voltage source 12, e.g., a nominal 24 volts AC at 60 Hz, for example as derived from a thermostat transformer. This is supplied to inputs of a full wave rectifier 14, which converts the voltage to direct current and applies it onto a positive rail 16 and a negative rail 18. In some applications, the direct current can be derived directly, e.g., from a motor vehicle, or a different rectifier can be employed. A DC relay 20 is shown here, with an actuator coil 22 that is magnetically coupled to a pair of relay contacts 24. An electrical load device 26 is shown coupled in series with the contacts 24 to a source of voltage V, which could be AC (either single phase or polyphase) or DC. The contacts 24 can be normally open or normally closed, depending on the application. Also shown here is a flyback protective diode 28 (optional) connected across the actuator coil 22.

The type of load device 26 is not critical to the invention, but the invention finds excellent application for high current draw, inductive loads, such as heavy duty ac induction motors.

The relay 20 can be of conventional design, or can for example be a hybrid electronic-electromechanical relay of the type described in U.S. Pat. No. 5,699,218, granted Dec. 16, 1997. The relay 20 can be selected with a rating that is at, or slightly below the low end of the operating voltage range. For example, for a range of 13 to 35 volts, the relay can be selected at 12 volts.

A microprocessor 30 is suitably programmed, as described shortly, to provide an output gating signal, or actuator signal to the control terminal (i.e., gate or base) of a switching transistor 32 (here shown as an FET) that is disposed in series with the relay coil 22. The coil 22 has one end tap connected to the positive rail 16 and its other end tap connected to a main electrode (here, the drain) of the transistor 32. The other main electrode, i.e., the source, is tied to the negative DC rail 18. It should be understood that other transistor types could be used rather than the FET here illustrated.

A voltage sensing circuit 33, here represented by a resistor and capacitor in series, is connected between the positive and negative rails 16, 18, and an output (here the junction of the resistor and capacitor) provides a pick-off voltage signal to a sensor input terminal of the microprocessor 30. The pick-off voltage signal is proportional to the actual DC voltage appearing across the rails 16, 18, which, as discussed previously, can vary over a considerable range above and below the nominal voltage (for example, between 13 and 35 volts). This permits the microprocessor to accommodate to the applied voltage and produce a pulse width modulated (PWM) signal whose duty cycle is proportional to the ratio of the actual applied voltage to a pre-selected minimum DC voltage level, or to the inverse thereof. As will be discussed below, this arrangement pulses the current through the actuator coil 22 and the transistor 32 to keep the DC current at a level that is sufficient to obtain and maintain contact closure, but avoids stressing the coil and does not waste energy.

An external sensor 34 (here a thermal sensor) is connected to an input of the microprocessor. This can be used to trigger the microprocessor into action, e.g., if the sensor temperature rises above a preset temperature (as a call for air conditioning), or falls below a lower preset temperature (as a call for heating). Other sensors can be employed depending on the application of the relay 20, or the actuation can be governed by an operator or functionality internal to the microprocessor 30. For example, the relay 20 can be actuated at preset times. Alternatively, an in-line switch 35 can govern relay actuation, e.g., a standard thermostat contact which can be interposed on an AC thermostat conductor.

Figure 2:
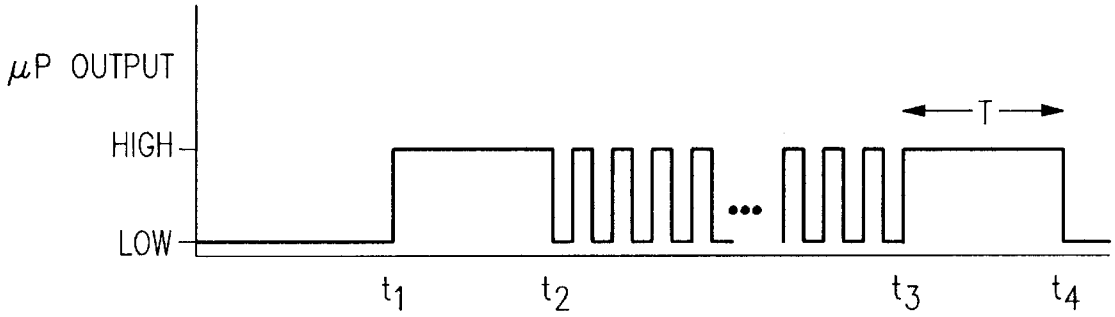
FIG. 2 shows the form of the microprocessor output signal for explaining operation of this embodiment.

As shown in FIG. 2, the microprocessor output, i.e., the actuator signal fed from the microprocessor 30 to the gate of the transistor 32, is initially off or low. Then, at a time $t_1$, the microprocessor 30 detects a call for relay actuation. The microprocessor 30 delivers a steady high, or DC signal for a time T to the transistor 32, so that DC current flows through the coil 22. This time T can be about one second. Then, beginning at time $t_2$, the microprocessor 30 delivers a pulse-width modulated signal, as shown. The ratio of the pulse width to the pulse period, that is, the duty cycle, is calculated based on the voltage signal appearing at the microprocessor input. The PWM signal can have a pulse rate of several hundred Hz to several KHz. This signal gates the transistor 32 on and off, so that pulsating DC passes through the coil 22. The duty cycle is a linear function of to the ratio of a predetermined minimum voltage to the actual voltage between the rails 16, 18. The duty cycle is high for lower voltages and low for higher voltages. This ensures that the average, or RMS current passing through the coil 22 will be sufficient for it to draw in the contacts 24 but will not exceed the rating of the relay coil. At the same time, as the transistor 32 is operated in a switch mode, there is no problem with heat dissipation.

The PWM actuator signal continues until the microprocessor 30 detects a call for shut off, as shown here at time $t_3$. The actuator signal now appears as a steady high for a time T, i.e., about one second, and then at a time $t_4$ goes to a steady low. This provides one second of direct current through the relay coil 22 at de-actuation, to assist in making a clean break of the contacts 24. The appearance of the one-second DC intervals at the commencement and termination of the actuating signal is optional. However, the DC intervals are preferred to ensure that closure and shut off are fast and clean, with minimal arcing and chatter-free performance.

Figure 3:
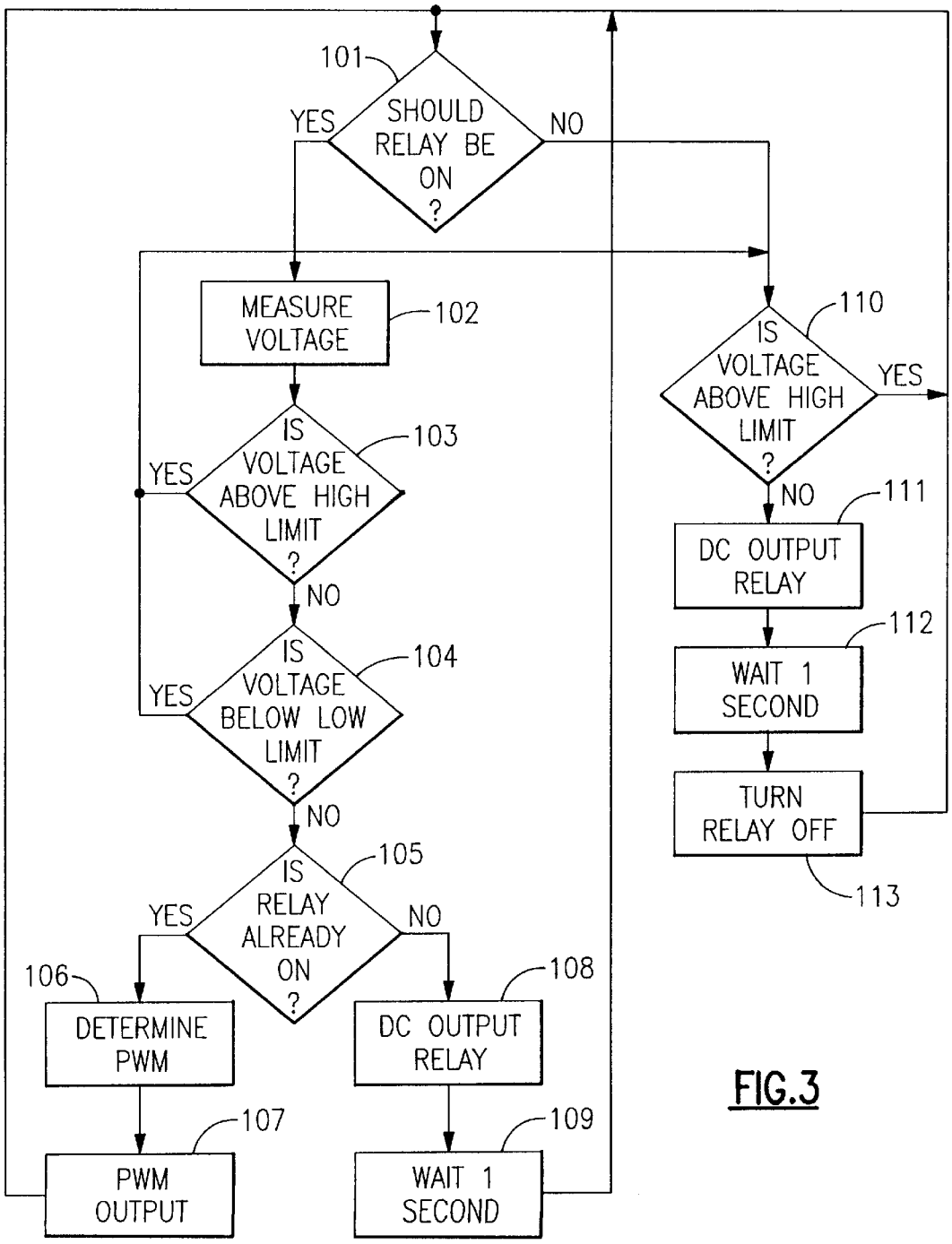
FIG. 3 is a flow chart for explaining operation of this embodiment.

The microprocessor is suitably programmed generally as illustrated in the flow chart of FIG. 3. At periodic intervals during the operation, the microprocessor determines whether the relay 20 is to be actuated ON (step [101]). Then the rail-to-rail voltage is measured, according to the input from the circuit 33, as in step [102]. The voltage level is compared with a high limit (step [103]) and if below this limit is then compared with a low limit (step [104]). If the measured voltage value is between these limits, the program proceeds to step [105], and tests to see if the relay is actuated or not. If the relay tests ON, then the microprocessor 30 computes a suitable duty cycle for the PWM signal (step [106]), and the PWM actuator signal is generated at the microprocessor output (step [107]) and is fed to the gate of the transistor 32. The program returns to step [101] and iterates these steps. On the other hand, if the relay is found not to be already ON (step [105]), then the microprocessor generates a DC output (step [108]) and supplies this to the switching transistor 32. The microprocessor continues in this state for one second (step [109]), and then reverts to step [101].

If the measured voltage is found to be above the high limit (step [103]) or below the low limit (step [104]), the program goes to a comparison step [110], and tests if the voltage is higher than the high limit. If so, the program returns to step [101]. Otherwise, that is, if the voltage is below the low limit, the microprocessor produces a DC signal to the transistor 32 (step [111]) and holds this condition for one second (step [112]). Thereafter, the microprocessor produces a steady low output to shut the relay 20 OFF (step [113]). Again, the program reverts to step [101] and iterates.

Figure 4:
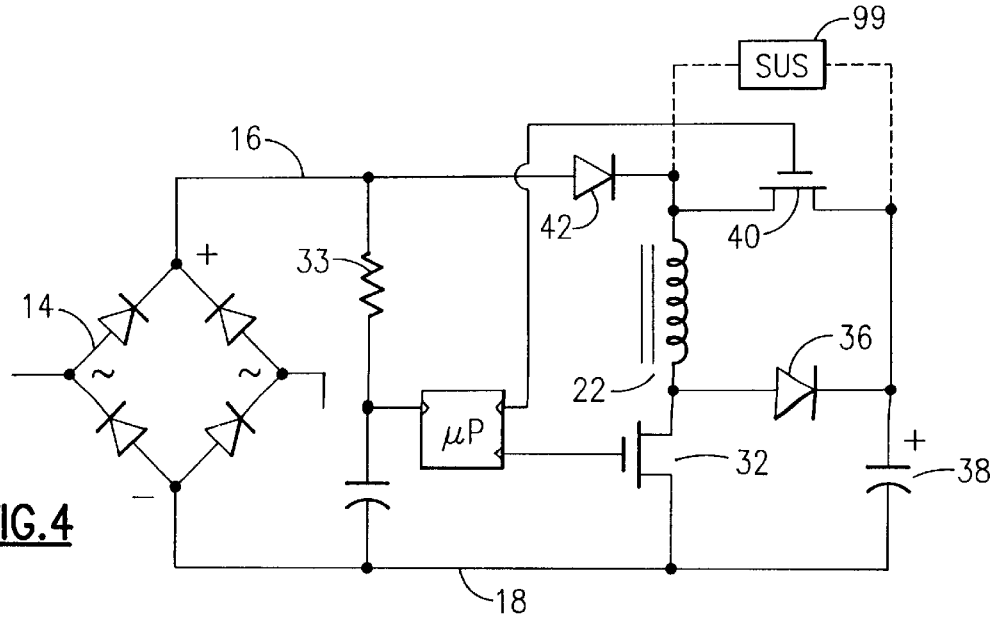
FIG. 4 is a circuit diagram of another embodiment of the invention.

Another embodiment of the relay control and actuation circuit of the present invention is shown in FIG. 4. Elements that are identical with those of the FIG. 1 embodiment are identified with the same reference characters, and a detailed description thereof will not be repeated. Here, there is a booster circuit connected with the actuator coil 22 for storing an increased voltage to actuate the coil 22 under low voltage conditions. This embodiment takes account of relay hysteresis, where a higher voltage is needed for actuation or pick-up of the coil than is needed later on for holding the relay contacts 24 in their actuated condition. This also permits the relay to be selected over a much wider range of ratings.

Here, a diode 36 has its anode connected to the junction of the coil 22 and the switching transistor 32. This diode permits the high flyback voltage, which appears at the pulsing OFF of the transistor 32, to pass on to a storage capacitor 38 that is connected at one end to the cathode of the diode 36 and at the other end to the negative rail 18. A switching transistor 40, whose gate is coupled to another output terminal of the microprocessor 30, has its current terminals connected to the storage capacitor 38 and the positive-rail side of the coil 22. An optional blocking diode 42 is positioned here between the positive rail 16 and the coil 22. In this embodiment, the flyback diode 28 would be omitted. In an alternative arrangement, a negative resistance device 99 can be employed in lieu of the switching transistor 40. As shown in FIG. 4, the negative resistance device 99 can be a silicon unilateral switch (SUS) or equivalent. With either the transistor 40 or the breakover device 99 the storage capacitor 38 charges, then turns to a relatively high voltage so that when the transistor 32 is activated, the relay 20 picks up even though the rail voltage would have been insufficient to fire it.

The microprocessor 30 switches the transistor 40 ON at the commencement of relay actuation, and the higher-voltage charge on the capacitor 38 is dumped through the coil to pull in the contacts. After that has been achieved, the lower voltage from the rails 16, 18 is sufficient to maintain the relay actuated. The control circuit otherwise operates in similar fashion to that of FIG. 1.

In the event that the relay has been unactuated for an extended time, and there is no charge on the capacitor 38, the microprocessor 30 will pulse the transistor 32 and coil 22 a few times to develop flyback voltage prior to actuating the second switching transistor 40.

While the invention has been described in detail with reference to certain preferred embodiments, it should be understood that the invention is not limited to those precise embodiments. Rather, many modifications and variations would present themselves to persons skilled in the art without departure from the scope and spirit of the invention, as defined in the appended claims.

We claim:

1. Actuator control circuit for energizing an actuator coil over a wide range of operating voltages, comprising:

source means for applying the actuating voltage across a pair of conductors;

a switching transistor having a control electrode and a pair of current electrodes, the current electrodes being connected in series with the actuator coil;

a microprocessor having a control output coupled to the control electrode of said switching transistor;

voltage sensing means connected across said pair of conductors, and having an output applying a voltage signal to a voltage input of said microprocessor, said voltage signal being proportional to the actuating voltage across said conductors within said range of operating voltages;

said microprocessor being programmed so as to produce, when actuation is called for, an actuator signal appearing at said control output which is pulse width modulated to have a duty cycle that is a linear function of said actuating voltage within said range of operating voltage.

2. Actuator control circuit according to claim 1, wherein said actuator is selected to have its actuation voltage at a lower end of said range.

3. Actuator control circuit according to claim 1, wherein said microprocessor is programmed to sense when relay actuation is called for, to sense if the voltage signal is above a lower limit, and if so to compute for said output signal a pulse width modulation duty cycle as a linear function of said voltage signal.

4. Actuator control circuit according to claim 1, wherein said microprocessor is programmed to generate at said control output a DC level for a predetermined time at commencement of said actuator signal.

5. Actuator control circuit according to claim 4, wherein said microprocessor is programmed to generate at said control output a DC level for a predetermined time at the termination of said actuator signal.

6. Actuator control circuit according to claim 1, further comprising actuation boost means for storing flyback voltage from pulsed operation of said switching transistor and applying an increased actuation voltage across the actuator coil at commencement of said actuator signal.

7. Actuator control circuit for energizing an actuator coil over a wide range of operating voltages, comprising:

source means for applying the actuating voltage across a pair of conductors;

a switching transistor having a control electrode and a pair of current electrodes, the current electrodes being connected in series with the actuator coil;

a microprocessor having a control output coupled to the control electrode of said switching transistor;

voltage sensing means connected across said pair of conductors, and having an output applying a voltage signal to a voltage input of said microprocessor, said voltage signal being proportional to the actuating voltage across said conductors within said range of operating voltages;

said microprocessor being programmed so as to produce, when actuation is called for, an actuator signal appearing at said control output which is pulse width modulated to have a duty cycle that is a linear function of said actuating voltage within said range of operating voltage; and actuation boost means for applying an increased actuation voltage across the actuator coil of said relay at commencement of said actuator signal;

wherein said actuation boost means includes a storage capacitor and a second switching device connected in series, a diode coupled on one side to a junction of said actuator coil and the first-mentioned switching transistor and on the other side to a junction of the storage capacitor and said second switching device to charge said storage capacitor with flyback voltage from said actuator coil, said second switching device being coupled to the actuator coil so that an increased actuation voltage stored on said storage capacitor passes to said actuator coil at commencement of the actuator signal.

8. Actuator control circuit according to claim 7, wherein said second switching device is a transistor having a control electrode coupled to an output of said microprocessor and a current electrode coupled to the relay actuator coil.

9. Actuator control circuit according to claim 7, wherein said second switching device includes a negative resistance device connected between said storage capacitor and the relay actuator coil.

* * * * *